US010362837B1

(12) United States Patent
Fink

(10) Patent No.: US 10,362,837 B1
(45) Date of Patent: Jul. 30, 2019

(54) CLOSURE APPARATUS

(71) Applicant: Fastech, Inc., Canton, MA (US)

(72) Inventor: Matthew Fink, Weston, MA (US)

(73) Assignee: Fastech Asia Worldwide, Ltd., Hong Kong (CN)

( * ) Notice: Subject to any disclaimer, the term of this patent is extended or adjusted under 35 U.S.C. 154(b) by 0 days.

(21) Appl. No.: 15/874,183

(22) Filed: Jan. 18, 2018

(51) Int. Cl.
*A44B 11/25* (2006.01)
*A41F 1/00* (2006.01)

(52) U.S. Cl.
CPC ..... *A44B 11/2588* (2013.01); *A41F 1/006* (2013.01)

(58) Field of Classification Search
CPC ..... A44B 11/2588; A41F 1/006
See application file for complete search history.

(56) References Cited

U.S. PATENT DOCUMENTS 796,414 A * 8/1905 Chayes ..... A41F 3/02 24/319
1,376,613 A 5/1921 Forsell
2,522,109 A 9/1950 Foltis
2,912,984 A 11/1959 Jensen
3,200,464 A 8/1965 Cousins
3,979,801 A 9/1976 Tareau
4,000,544 A * 1/1977 Fildan ..... A41C 3/02 24/312
4,052,774 A * 10/1977 Noda ..... A44B 11/2588 24/587.12
4,054,972 A 10/1977 Rowell
4,161,806 A * 7/1979 Hennisse ..... A41F 1/006 24/586.11
D274,293 S * 6/1984 Goepfer ..... D11/212
4,539,736 A * 9/1985 Yokosuka ..... A44B 11/25 24/265 WS
D352,678 S * 11/1994 Fildan ..... D11/212
5,377,394 A 1/1995 Fildan
5,380,238 A * 1/1995 Crew-Gee ..... A41C 3/02 2/73
D398,881 S 9/1998 France-Davis
6,009,604 A * 1/2000 Fildan ..... A41F 1/006 24/318
D440,905 S 4/2001 Fildan et al.
6,859,982 B1 3/2005 Carrillo
9,756,906 B1 9/2017 Fink
(Continued)

OTHER PUBLICATIONS http://img.alibaba.com/img/pb/961/652/269/1286195738435_hz-fileserver1_6501131.jpg, retrieved on Jun. 27, 2014.
(Continued)

*Primary Examiner* — Robert Sandy
*Assistant Examiner* — David M Upchurch
(74) *Attorney, Agent, or Firm* — Pryor Cashman LLP

(57) ABSTRACT

A closure includes a male closure member including a first loop, an arm, a bar, and a first loop extension extending orthogonally from the first loop, and a female closure member including a base portion having a top edge, a bottom edge, a blind hole into which the bar of the male closure member is insertable, a resilient protrusion disposed in and extending from the base portion at a position proximal to the bottom edge and configured to removably secure the first loop extension upon insertion and rotation of the bar in the blind hole, and a recess configured to receive the arm of the male closure member.

5 Claims, 8 Drawing Sheets

(56) References Cited

U.S. PATENT DOCUMENTS

| | | | | |
|---|---|---|---|---|
| 2002/0095752 | A1* | 7/2002 | Fildan | A41F 1/006<br>24/586.11 |
| 2016/0113341 | A1* | 4/2016 | Fildan | A44B 11/2596<br>450/91 |

OTHER PUBLICATIONS

Written Opinion of the International Searching Authority in PCT/US2019/014318 (dated May 14, 2019).
International Search Report in PCT/US2019/014318 (dated May 14, 2019).

* cited by examiner

CLOSURE APPARATUS

TECHNICAL FIELD

The present invention relates generally to closures, and particularly to closures for reversibly securing two items to one another.

BACKGROUND OF THE INVENTION

Although closures for reversibly securing two items are known in the prior art, the present invention represents an improved mechanism for securement over existing closures.

SUMMARY OF THE INVENTION

It is an object of the present invention to provide a closure mechanism that provides for reversibly securing two items. The invention is applicable to any application that requires a closure to reversibly secure two items. For example, the present invention is applicable to the field of apparel, such as the center gore for brassieres.

In general, in one aspect, the invention features a closure including a male closure member including a first loop, an arm fixedly attached to the first loop, a bar fixedly attached to the arm, the bar having an upper portion extending orthogonally from the arm in a first direction and a lower portion extending orthogonally from the arm in a second direction opposite the first direction, and a first loop extension fixedly attached to the first loop and extending orthogonally from the first loop in the second direction, and a female closure member including a second loop and a base portion fixedly attached to the second loop, the base portion including a top edge, a bottom edge, a blind hole extending from the top edge toward the bottom edge into which the bar of the male closure member is insertable at the top edge and moveable along and configured for rotational pivoting of the bar in the blind hole, a resilient protrusion disposed in and extending from the base portion at a position proximal to the bottom edge and configured to removably secure the first loop extension upon insertion and rotation of the bar in the blind hole, and a recess configured to receive the arm attached to the bar inserted in the blind hole and positioned such that the upper portion of the bar and the lower portion of the bar are disposed between the top edge and the bottom edge.

Implementations of the invention may include one or more of the following features. The male closure member and/or the female closure member may be formed from metal or plastic. The second loop and the base portion may be formed from metal. The protrusion may be formed from plastic.

BRIEF DESCRIPTION OF THE DRAWINGS

The above-mentioned and other aspects, features, and advantages can be more readily understood from the following detailed description with reference to the accompanying drawings wherein.

DETAILED DESCRIPTION OF THE INVENTION

Figure 1:
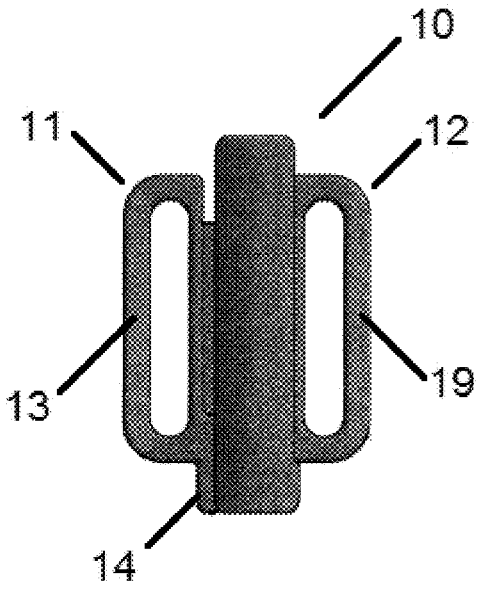
FIG. 1 shows a front view of a closure apparatus with the closure members secured according to an embodiment of the present invention.
Figure 2:
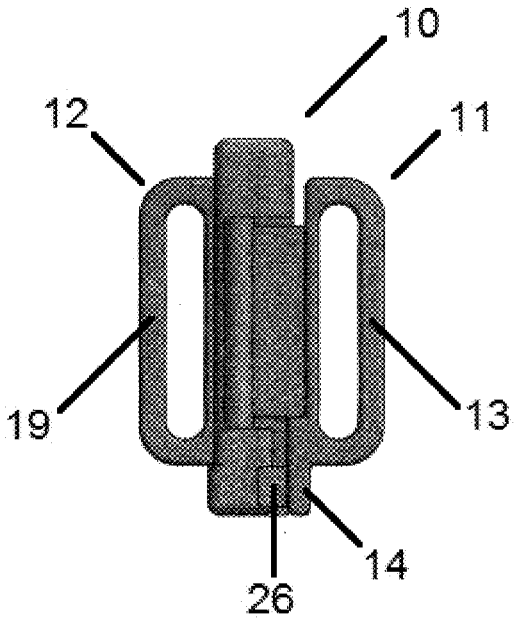
FIG. 2 shows a back view of the closure apparatus of FIG. 1 with the closure members secured.
Figure 3:
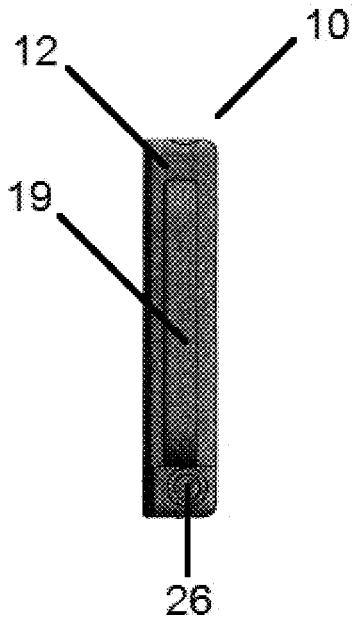
FIG. 3 shows a side view of the closure apparatus of FIG. 1 with the closure members secured.
Figure 4:
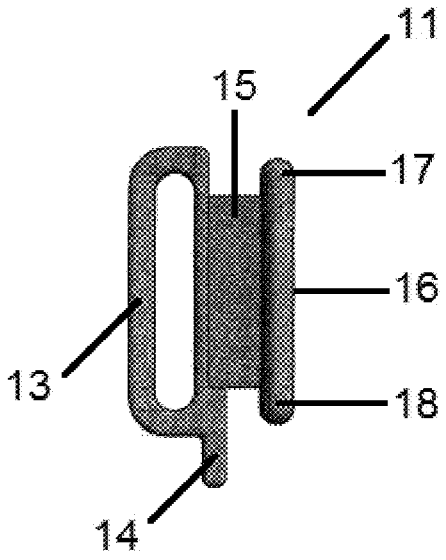
FIG. 4 shows a front view of the male closure member of the closure apparatus of FIG. 1.
Figure 5:
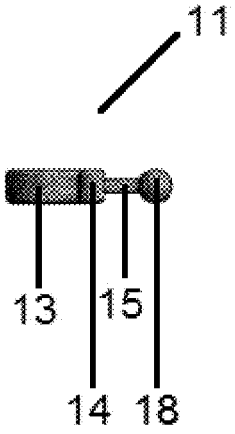
FIG. 5 shows a bottom view of the male closure member of the closure apparatus of FIG. 1.
Figure 6:
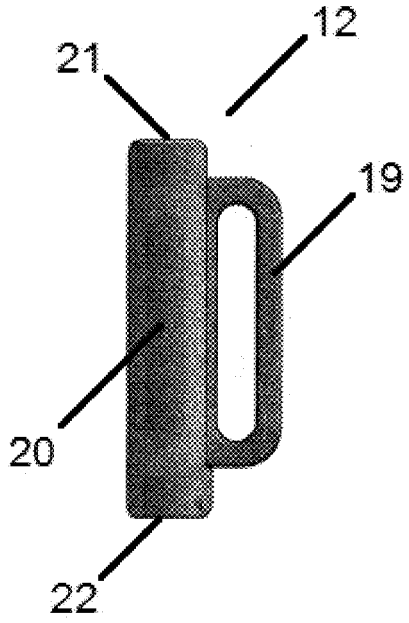
FIG. 6 shows a front view of the female closure member of the closure apparatus of FIG. 1.
Figure 7:
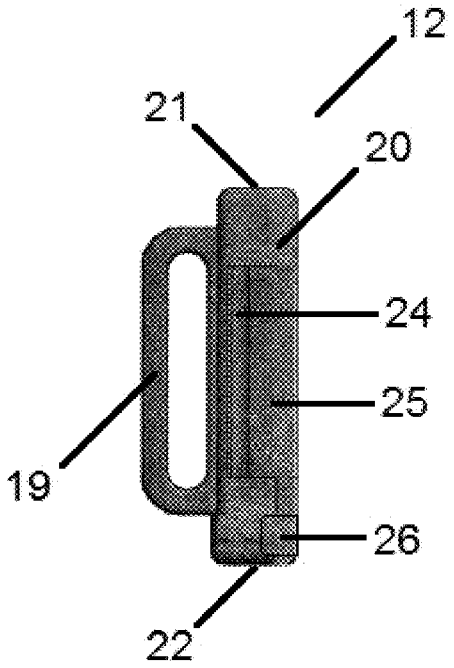
FIG. 7 shows a back view of the female closure member of the closure apparatus of FIG. 1.

The present invention provides a closure 10 for reversibly securing two items together, as shown in FIGS. 1-7. Closure 10 includes two components, namely a male closure member 11 and a female closure member 12.

Male closure member 11 includes a first loop 13, a first loop extension 14, an arm 15 that is fixedly attached to first loop 13, and a bar 16 that is fixedly attached to arm 15. Bar 16 has an upper portion 17 and a lower portion 18 which extend orthogonally from the arm in opposite directions. First loop 13, first loop extension 14, arm 15, and bar 16 lie substantially in the same plane.

Female closure member 12 includes a second loop 19 and a base portion 20 that is fixedly attached to second loop 19. Base portion 20 has a top edge 21 and a bottom edge 22. Top edge 21 has a blind hole 24, which extends from top edge 21 toward bottom edge 22. Bar 16 of male closure member 11 can be inserted into blind hole 24 at top edge 21 and slid along blind hole 24 toward bottom edge 22. Upon complete insertion, lower portion 18 of bar 16 rests at a bottom portion of blind hole 24. Base portion 20 includes a recess 25 for receiving arm 15. Base portion 20 also includes a resilient protrusion 26 that extends therefrom and configured to removably secure first loop extension 14 of male closure member 11 to female closure member 12 upon insertion and rotation of bar 16 in blind hole 24, providing further securement of male closure member 11 with female closure member 12 when these elements are engaged. In particular, protrusion 26 has sufficient resiliency such that first loop extension 14 may pass across and over protrusion 26 with minimal applied force and male closure member 11 will be held in place by protrusion 26.

Bar 16 of male closure member 11 may be inserted into blind hole 24 at top edge 21 of base portion 20 such that the plane of male closure member 11 is orthogonal to base portion 20 of female closure member 12. Bar 16 is slid along blind hole 24 until lower portion 18 of bar 16 rests at a bottom portion of blind hole 24. Male closure member 11 may then be rotatably pivoted about bar 16 so that male closure member 11 is substantially coplanar with base portion 20, arm 15 is received in recess 25, and first loop extension 14 is removably secured by protrusion 26.

The components of closure 10, including male closure member 11, female closure member 12, and protrusion 26, may be made from any durable, non-deformable, and strong material. Such material may be a metal, such as steel, stainless steel, copper or brass, zinc alloy, or plastic. In a preferred embodiment, protrusion 26 is plastic.

Items can be removably secured to one another through attachment of one to first loop 13 of male closure member 11 and the other to second loop 19 of female closure member 12. For example, the looped ends of corresponding brassiere straps may be attached to first loop 13 and second loop 19, respectively.

Figure 8:
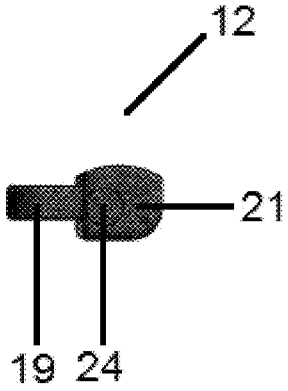
FIG. 8 shows a top view of the female closure member of the closure apparatus of FIG. 1.

FIGS. 1-8 illustrate varying views of closure 10 and its components.

The embodiments and examples above are illustrative, and many variations can be introduced to them without departing from the spirit of the disclosure or from the scope of the appended claims. For example, elements and/or features of different illustrative and exemplary embodiments herein may be combined with each other and/or substituted with each other within the scope of this disclosure. The objects of the invention, along with various features of novelty that characterize the invention, are pointed out with particularity in the claims annexed hereto and forming a part of this disclosure. For an understanding of the invention, its operating advances and the specific objects attained by its uses, reference should be had to the accompanying drawings and descriptive matter in which there is illustrated a preferred embodiment of the invention.

What is claimed is:

1. A closure comprising:

a male closure member comprising:

a first loop;

an arm fixedly attached to the first loop;

a bar fixedly attached to the arm, the bar having an upper portion extending orthogonally from the arm in a first direction and a lower portion extending orthogonally from the arm in a second direction opposite the first direction; and a first loop extension fixedly attached to the first loop and extending orthogonally from the first loop in the second direction; and a female closure member comprising:

a second loop; and a base portion fixedly attached to the second loop, the base portion comprising:

a top edge;

a bottom edge;

a blind hole extending from the top edge toward the bottom edge into which the bar of the male closure member is insertable at the top edge and moveable along and configured for rotational pivoting of the bar in the blind hole;

a resilient protrusion disposed in and extending from the base portion at a position proximal to the bottom edge and configured to secure the first loop extension upon insertion and rotation of the bar in the blind hole; and a recess configured to receive the arm attached to the bar inserted in the blind hole and positioned such that the upper portion of the bar and the lower portion of the bar are disposed between the top edge and the bottom edge.

2. The closure of claim 1, wherein the male closure member is formed from metal or plastic.

3. The closure of claim 1, wherein the female closure member is formed from metal or plastic.

4. The closure of claim 1, wherein the second loop and the base portion are formed from metal.

5. The closure of claim 1, wherein the resilient protrusion is formed from plastic.

* * * * *